United States Patent [19]

Ross

[11] Patent Number: 4,941,823

[45] Date of Patent: Jul. 17, 1990

[54] VERTICAL AIR FLOW INGOT PUSHER FURNACE WITH ADJUSTABLE SIDE BAFFLES

[75] Inventor: Robert H. Ross, Meadville, Pa.

[73] Assignee: Seco/Warwick Corporation, Meadville, Pa.

[21] Appl. No.: 446,062

[22] Filed: Dec. 5, 1989

[51] Int. Cl.[5] ..... F27B 9/04

[52] U.S. Cl. ..... 432/152; 432/144; 432/176

[58] Field of Search ..... 432/152, 145, 146, 144, 432/143, 48, 82

[56] References Cited

U.S. PATENT DOCUMENTS 4,012,190 3/1977 Dicks et al. ..... 432/144

4,516,012 5/1985 Smith et al. ..... 432/176

4,518,352 5/1985 Gillhams et al. ..... 432/152

4,591,338 5/1986 Sahai et al. ..... 432/152

4,729,735 3/1988 Ross ..... 432/152

*Primary Examiner*—Henry C. Yuen

*Attorney, Agent, or Firm*—Davis Chin

[57] ABSTRACT

An ingot pusher furnace of the vertical air flow type includes adjustable side baffles hingedly connected to lower ends of respective vertical side baffles to prevent the "short circuiting" of heated gases around the ends of an ingot to be heated. The adjustable side baffles are movable from a vertical position to an angled position so that its upper ends are in closely spaced proximity with the outer faces on the end portions of the shorter length ingot so as to produce a more uniform and faster heat transfer along the entire length thereof.

7 Claims, 3 Drawing Sheets

VERTICAL AIR FLOW INGOT PUSHER FURNACE WITH ADJUSTABLE SIDE BAFFLES

BACKGROUND OF THE INVENTION

This invention relates generally to ingot pusher furnaces and more particularly, to an improved ingot pusher furnace of the vertical air flow type which includes adjustable side baffles hingedly connected to lower ends of respective vertical fixed side baffles to prevent the "short circuiting" of heated gases around the ends of an ingot to be heated, thereby producing a more uniform and faster heat transfer along the length of the ingot.

As is generally known heretofore, ingot pusher furnaces of the prior art have been designed so as to accommodate very large sizes of aluminum ingots to be heated. Typically, these aluminum ingots are in the range of ten to thirty feet in length, three to six feet in width, and ten to thirty inches in thickness. Some of these prior art ingot pusher furnaces have fixed side baffles disposed adjacent the ends of the ingot whose length is at the maximum acceptable by the furnace. However, such prior art furnaces are often used to heat ingot with a shorter length. During the heating of the shorter length ingots in such furnaces, a substantial amount of the heating medium is generally "short circuited" between the fixed side baffles and the ends of the ingot to be heated. This is because the path of least resistance for the gas flow is around the ends of the ingot. Consequently, the end portions of the ingot are often over-heated and generally have a much higher temperature than the central portions thereof, thereby causing non-uniform heating of the aluminum ingots.

In U.S. Pat. No. 4,729,735 entitled "Vertical Air Flow Ingot Pusher Furnace" which issued on Mar. 8, 1988, there is disclosed an ingot pusher furnace of vertical air flow type which includes a horizontal baffle and a pair of vertical side baffles. The horizontal baffle has connecting members and extends from a rear wall to a front wall of the furnace. The vertical side baffles are disposed in a parallel, spaced apart relationship to side walls of the furnace enclosure. Each of the vertical baffles also extend from the rear wall of the enclosure to the front wall thereof. Each of the vertical baffles is provided with an upper end and a lower end. The respective upper ends of the vertical side baffles are pivotally attached to the horizontal baffle via the connecting members. The side baffles are movable between a vertical position and an angled position so as to force the gaseous medium to flow toward the center portions of the ingots.

The present invention represents an alternative arrangement to the '735 patent which is assigned to the same assignee as this application and is hereby incorporated by reference. The ingot pusher furnace of the instant invention includes a pair of adjustable side baffles hingedly connected to lower ends of vertical fixed side baffles to prevent the "short circuiting" of the heated gases around the ends of the ingots to be heated.

SUMMARY OF THE INVENTION

Accordingly, it is a general object of the present invention to provide an improved ingot pusher furnace of the vertical air flow type which is relatively simple and economical to manufacture and assemble.

It is an object of the present invention to provide an improved ingot pusher furnace of the vertical air flow type which includes adjustable side baffles hingedly connected to lower ends of respective vertical fixed side baffles to force the heated gases to flow toward the center portions of the ingot so as to facilitate uniform heat transfer.

In the embodiment of the present invention, there is provided an improved ingot pusher furnace of the vertical air flow type which includes an insulated furnace enclosure formed by a bottom wall, a pair of side walls, a front wall, a rear wall, and a top wall. The enclosure receives a plurality of ingots to be heated. A plurality of heat sources are provided to heat a gaseous medium within the enclosure. A plurality of fans are provided to circulate the gaseous medium within the enclosure. A pair of vertical fixed side baffles are disposed in a parallel, spaced apart relationship to the side walls of the enclosure. Each of the vertical fixed side baffles extend from the rear wall of the enclosure to the front wall thereof. Each of the vertical fixed side baffles has an upper end and a lower end. A horizontal baffle has connecting members and extends from the rear wall to the front wall. The connecting members are joined fixedly to the upper ends of the vertical fixed side baffles.

There are provided adjustable side baffles, each having its one end pivotally attached to the respective lower ends of the vertical fixed side baffles. The adjustable side baffles are movable between a vertical position and an angled position. The adjustable side baffles force the gaseous medium contained in the enclosure to flow toward the center portions of the ingots when in the angled position so as to provide uniform heating throughout the ingot.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
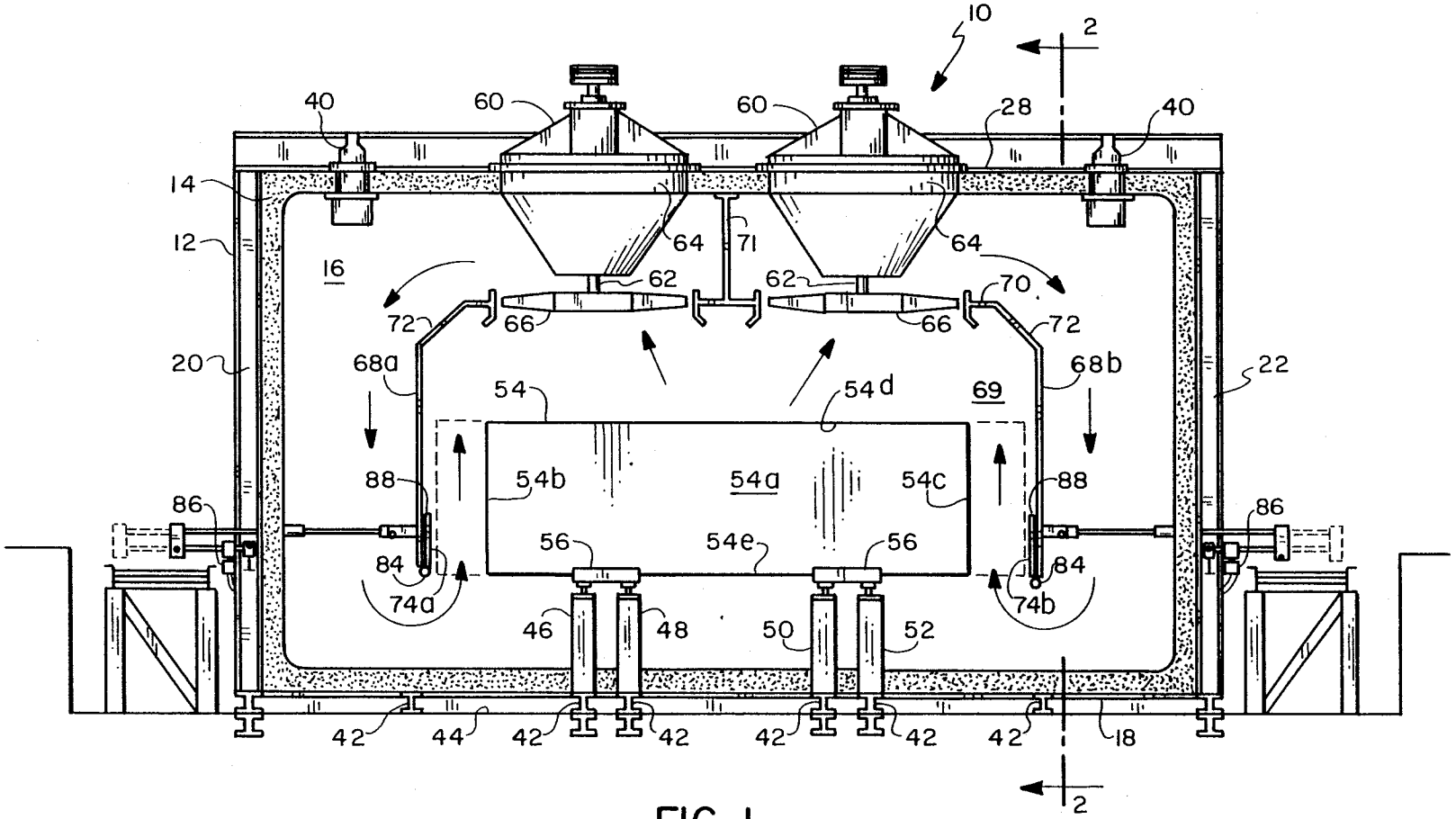
FIG. 1 is a front elevational view of an ingot pusher furnace of the vertical air flow type, constructed in accordance with the principles of the present invention.
Figure 2:
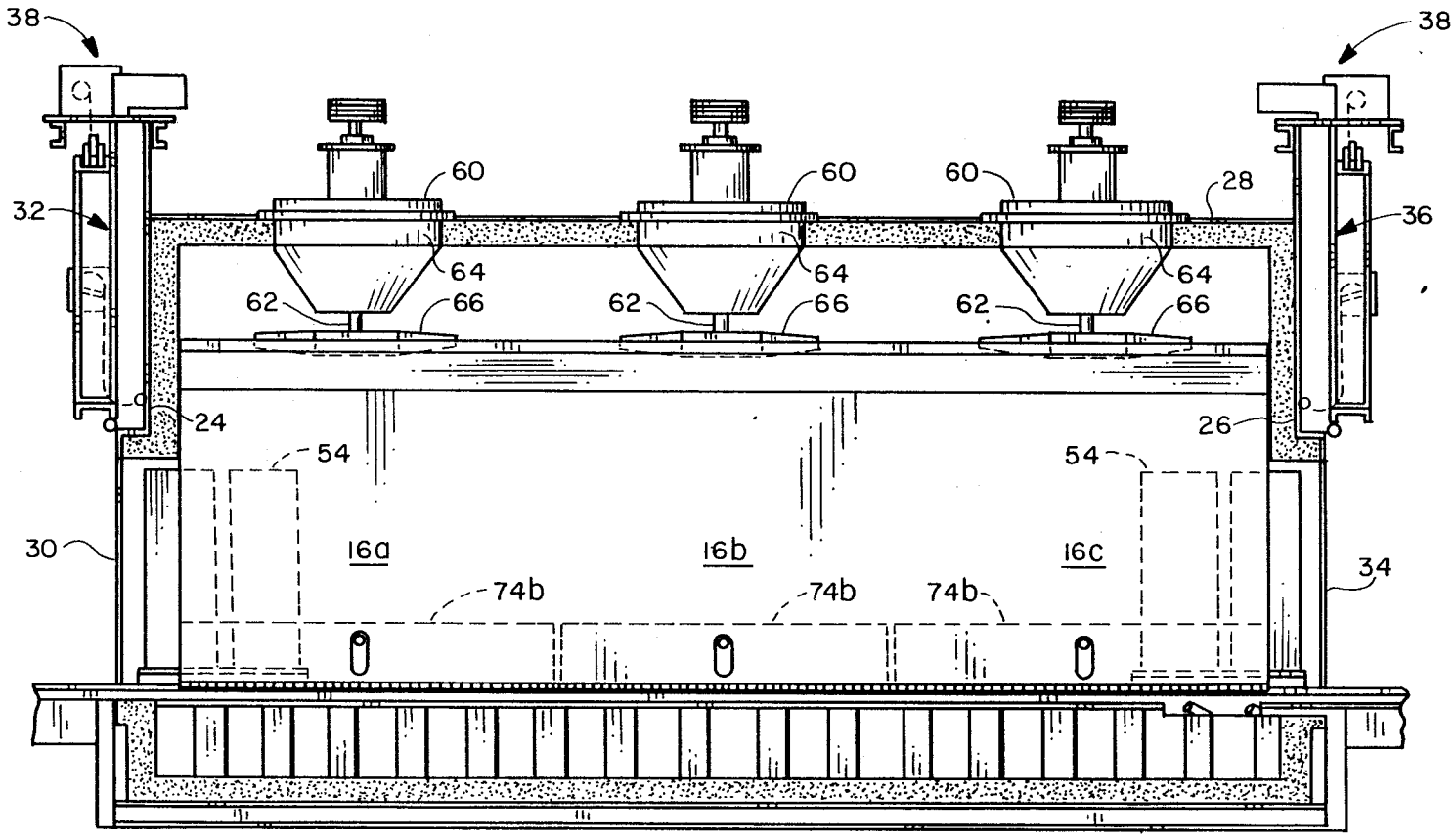
FIG. 2 is a side elevational view of the furnace, taken along the lines 2-2 of FIG. 1.
Figure 3:
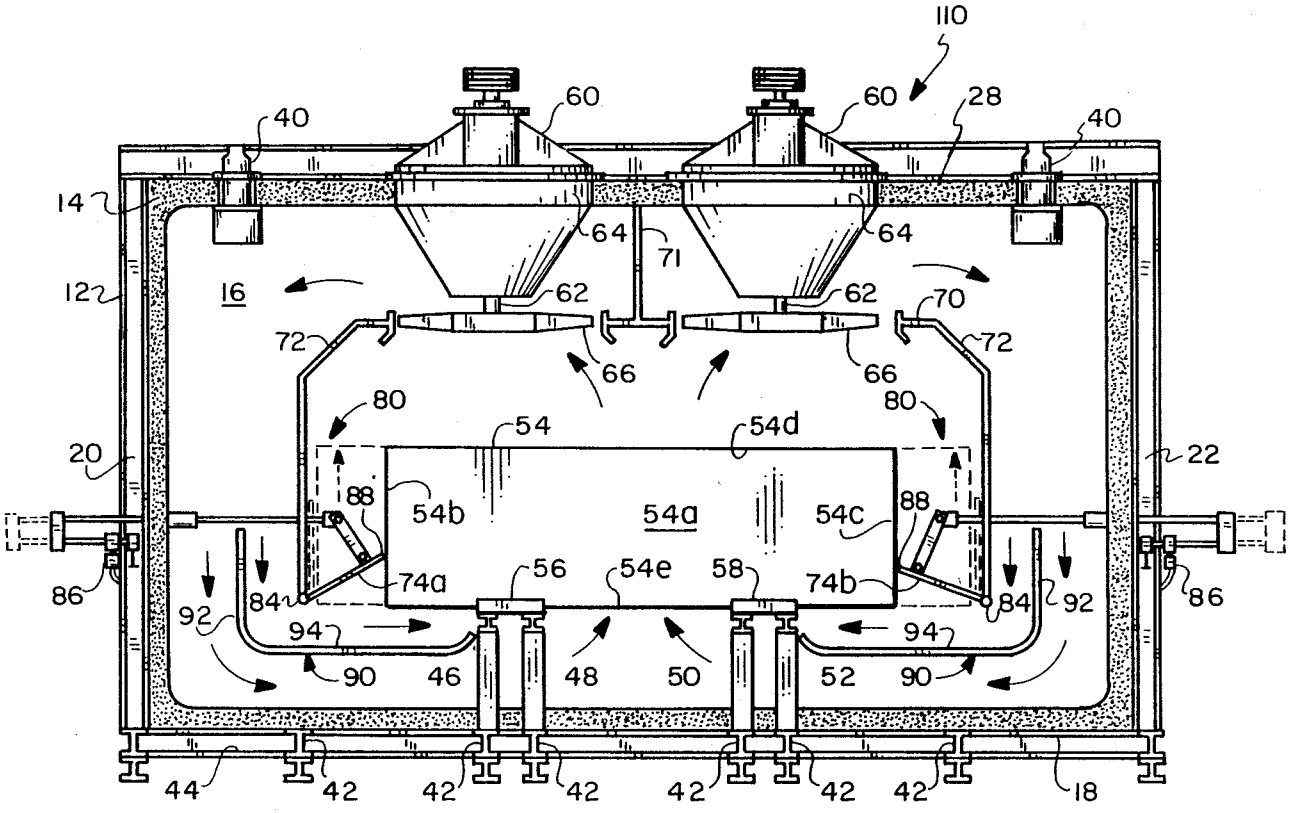
FIG. 3 is a front elevational view similar to FIG. 1, illustrating the adjustable side baffles in the angled position.

Referring now in detail to the various views of the drawings, there is illustrated in FIGS. 1 through 3 an improved ingot pusher furnace of the vertical air flow type which is constructed in accordance with the principles of the present invention and is designated generally by reference numeral 10. The improved ingot pusher furnace is formed of a sheet metal outer shell 12 with a layer 14 of insulating refractory material on its interior to define an insulated enclosure 16. The pusher furnace 10 includes a bottom wall 18, a pair of side walls 20 and 22, a front wall 24, a rear wall 26 and a top wall or roof 28. The front wall 24 is formed with a large entrance opening 30 which is covered by a front door 32. The rear wall 26 is formed with a large exit opening 34 which is covered by a rear door 36. The front and rear doors are adapted to slide in a vertical plane under the control of elevating mechanisms 38 which are well known in the art.

A plurality of conventional gas burners 40 are positioned in the top wall 28 and deliver a hot gaseous medium to the insulated enclosure 16. In alternate embodiments of the pusher furnace, radiant tube gas fired heaters or electric heaters may be utilized to heat the enclosure 16. The insulated enclosure 16 is divided into a plurality of heating zones 16*a*, 16*b* and 16*c*. As can be seen from FIG. 1 the bottom wall 18 is supported on a plurality of I-beams 42 which are disposed above the surface 44. A plurality of rail support posts 46, 48, 50 and 52 are formed in the bottom wall 18 which facilitates the support and movement of a plurality of aluminum ingots 54 to be heated within the enclosure 16. The ingots 54 are substantially rectangular in shape and have a center portion 54*a*, a first end portion 54*b*, a second end portion 54*c*, a top portion 54*d*, and a bottom portion 54*e*. The rail support posts 46 and 48 support a shoe assembly 56 via support rails, and the rail support posts 50 and 52 support a shoe assembly 58 via support rails. The shoe assemblies 56 and 58 are used to support the underneath surface of the aluminum ingots 54.

The top wall 28 supports a plurality of large recirculating fan assemblies 60. Each of the recirculating fan assemblies 60 includes a vertical extending support shaft 62 which is journalled in a mounting frame 64 disposed on the roof 28. A large axial flow or centrifugal fan member 66 is positioned on the lower end of the shaft 62. In order to rotate the shaft, a motor (not shown) may be provided. It should be understood that the shaft 62 may be rotated by the motor in either direction for an axial fan so as to cause the fan member 62 when rotated to move a hot gaseous medium either upwardly in the direction of the arrows as shown in FIG. 1 or downwardly in a direction opposite to the arrows. Although in the embodiment disclosed there are two rows of fans extending through each of the heating zones for the entire length of the furnace, it should be apparent to those skilled in the art that only a single fan in each heating zone could be employed alternatively.

Within the enclosure 16, there are provided a pair of vertical fixed side baffles 68*a*, 68*b* which are arranged to extend vertically and in a parallel, spaced apart relationship to the side walls 20 and 22 respectively. Further, the vertical fixed side baffles 68*a* and 68*b* extend from the rear wall 26 to the front wall 44. A horizontal baffle 70 is arranged in a generally horizontal position at the level of the fan member 66 and is connected to the upper ends of the vertical fixed side baffles 68*a*, 68*b* by outwardly and downwardly connecting members 72. The horizontal baffle 70 with its outwardly sloping connecting member 72 extends from the rear wall 26 to the front wall 24 of the enclosure 16. The horizontal baffle 70 is formed with openings to receive the fan members 66 therein. A vertical air flow divider 71 has its one end connected to the vertical horizontal baffle and its other end connected to the roof 28 for air flow control.

In addition, a pair of smaller adjustable side baffles 74*a* and 74*b* have their respective outer ends 84 pivotally or hingedly attached to the lower ends of the vertical fixed side baffles 68*a* and 68*b*. It will be noted that the adjustable side baffles are smaller in length than the vertical fixed side baffles. A working chamber 69 is defined by the horizontal baffle 70, vertical fixed side baffles 68*a*, 68*b*, and the adjustable side baffles 74*a*, 74*b*. Actuating means formed of electromechanical linear actuators 86 are adapted for moving the adjustable side baffles 74*a*, 74*b* between a vertical position as shown in FIG. 1 and an angled position shown in FIG. 3.

Referring to FIGS. 1 and 2, it can be seen that an ingot of a maximum length which is acceptable for heating in the furnace is depicted in a dotted line. An ingot of a minimum length which is acceptable to be heated in the furnace is depicted in a solid line. It is important to note that the furnace can accommodate ingots of a varying size which ranges between the maximum length and the minimum length. The vertical fixed side baffles 68*a* and 68*b* are designed to be in closely spaced proximity adjacent outer faces of the maximum length ingot. In the vertical position, the adjustable side baffles are disposed in a substantially flush relationship to the inner surfaces of the respective vertical fixed side baffles.

In normal operating conditions for heating the shortest length ingot 54 (shown in solid line) in FIG. 1, the fan member 66 is rotated by the motor in such a direction so that the heated gases travel upwardly through the working chamber 69 discharging them towards the roof 28 of the furnace. The gases thus discharged are divided and moved outwardly toward the respective side walls 20 and 22. Then, the gases are caused to circulate downwardly between the respective vertical fixed side baffles 68*a*, 68*b* and the side walls. At the bottom of the furnace enclosure 16, the gases are restricted and are thus caused to move inwardly towards the center portion 54*a* of the ingots.

Since the adjustable side baffles 74*a* and 74*b* are in the vertical position, most of the heated gases are "short circuited" around the ends of the ingots since this path will have the least resistance. This "short circuited" path is indicated by the dotted arrows in FIG. 1. As a result, the majority of the circulating gases would be passed upwardly between the vertical fixed side baffles and the ends of the ingot, thereby tending to overheat the outer faces of the ingot in comparison to the center portions thereof.

In order to prevent this short circuiting of the heated gases around the ends of the shorter length ingots to be heated, the adjustable side baffles 74*a*, 74*b* are moved to the angled position shown in FIG. 3 so that the upper ends 88 thereof are located in closely spaced proximity or in abutting relationship with the outer faces on the end portions 54*b* and 54*c* of the shorter length ingot. When the adjustable side baffles are so positioned, the circulating gases passing downwardly between the respective vertical fixed side baffle 68*a*, 68*b* and the side walls 20, 22 are prevented from short circuiting between the ends of the ingot and the vertical fixed side baffles, but are rather forced to flow towards the center portion 54*a* of the ingot as indicated by the curved arrows. Consequently, the entire length of the ingots between the first end portion 54*b* and the second end portion 54*c* are heated uniformly, thereby effecting a substantially uniform heat rate and temperature uniformity throughout its interior.

It should be understood that the actuating means could be formed of pneumatic or hydraulic cylinders, screw jacks and the like in an alternate embodiment for moving of the adjustable side baffles 74*a*, 74*b*. Further, each of the adjustable side baffles may be formed as a single continuous plate member which extends between the rear wall 26 and the front wall 24 of the enclosure 16. Alternately, each of the adjustable side baffles could be made of a plurality of shorter plate members with one or more plate members in the length of the furnace. In such alternate embodiment, it would be expedient to provide a corresponding number of actuating means so as to move each shorter plate member independently of each other.

In order to further direct more of the circulating gases to flow towards the center portion 54*a* of the ingot, a pair of L-shaped vanes 90 may be arranged to surround the lower ends of the ingot. Each of the vanes 90 includes a vertical portion 92 and a horizontal portion 94. The vertical portion 92 extends vertically and substantially intermediate the vertical fixed side baffles 68*a*, 68*b* and the side walls 20 and 22, respectively. The horizontal portion 94 is joined integrally to one end of the vertical portion and extends to the shoe assemblies 56 and 58 disposed under the center portion of the ingot.

From the foregoing detailed description, it can thus be seen that the present invention provides an improved ingot pusher furnace of the vertical air flow type which includes adjustable side baffles hingedly connected to lower ends of respective vertical fixed side baffles to prevent the "short circuiting" of the heated gases around the ends of the ingot to be heated so as to produce a more uniform heat transfer along the entire length of the ingot. The adjustable side baffles are movable from a vertical position to an angled position so as to be in closely spaced proximity with the outer faces on the end portions of the shorter length ingots.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An ingot pusher furnace of the vertical air flow type comprising:

an insulating furnace enclosure formed by a bottom wall, a pair of side walls, a front wall, a rear wall and a top wall, said enclosure receiving a plurality of ingots to be heated whose length is at a minimum acceptable by the furnace;

means for heating said enclosure by heating a gaseous medium therein:

means for moving said gaseous medium within said enclosure:

a pair of vertical fixed side baffles disposed in a parallel, spaced apart relationship to said side walls of said enclosure, each of said vertical fixed side baffles extending from the rear wall of said enclosure to the front wall thereof, each of said vertical fixed side baffles having an upper end and a lower end;

a horizontal baffle having connecting members and extending from said rear wall to said front wall, said connecting members being joined fixedly to respective upper ends of said vertical fixed side baffles;

adjustable side baffles each having its one end pivotally attached to the respective lower ends of said vertical fixed side baffles, said adjustable side baffles being movable between a vertical position and an angled position;

a pair of L-shaped vanes surrounding the ends of the ingots; and each of said L-shaped vanes including a vertical portion and a horizontal portion, the vertical portion extending vertically and substantially intermediate the respective vertical fixed side baffles and said side walls, the horizontal position being joined integrally at its one end to the vertical portion and extending towards the center of the ingot, whereby said adjustable side baffles forcing said gaseous medium contained in said enclosure to flow towards the center portions of the ingots when in the angled position so as to provide uniform heating throughout the ingot.

2. An ingot pusher furnace as claimed in claim 1, wherein said means for moving said gaseous medium within said enclosure comprises at lease one fan mounted upon said top wall of said enclosure.

3. An ingot pusher furnace as claimed in claim 1, further comprising actuating means for moving said adjustable side baffles between the vertical position and the angled position.

4. An ingot pusher furnace as claimed in claim 3, wherein said actuating means comprises an electromechanical linear actuator.

5. An ingot pusher furnace as claimed in claim 1, wherein each of said adjustable side baffles is disposed in a substantially flush relationship to the inner surfaces of the respective vertical fixed side baffles in the vertical position.

6. An ingot pusher furnace as claimed in claim 1, wherein each of said adjustable side baffles has its upper end disposed in closely spaced proximity to the ends of said ingots in the angled position.

7. An ingot pusher furnace as claimed in claim 1, wherein each of said adjustable side baffles is smaller in length than said vertical fixed side baffles.

* * * * *